US011118503B2

(12) United States Patent
Andersson et al.

(10) Patent No.: US 11,118,503 B2
(45) Date of Patent: Sep. 14, 2021

(54) INTERNAL COMBUSTION ENGINE

(71) Applicant: VOLVO TRUCK CORPORATION, Gtöeborg (SE)

(72) Inventors: Arne Andersson, Mölnlycke (SE); Staffan Lundgren, Hindås (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 102 days.

(21) Appl. No.: 16/488,811

(22) PCT Filed: Mar. 15, 2017

(86) PCT No.: PCT/EP2017/056108
§ 371 (c)(1),
(2) Date: Aug. 26, 2019

(87) PCT Pub. No.: WO2018/166591
PCT Pub. Date: Sep. 20, 2018

(65) Prior Publication Data

US 2021/0108559 A1 Apr. 15, 2021

(51) Int. Cl.
*F02B 41/06* (2006.01)

(52) U.S. Cl.
CPC ..... *F02B 41/06* (2013.01); *F02B 2710/025* (2013.01)

(58) Field of Classification Search
CPC ..... F02B 2720/025; F02B 2700/025; F02B 2710/025; F02B 41/06
See application file for complete search history.

(56) References Cited

U.S. PATENT DOCUMENTS 967,828 A 8/1910 Pierson
2,534,590 A * 12/1950 Gerhardt ..... F02B 57/02 123/52.5
8,646,421 B2 * 2/2014 Durrett ..... F02B 41/06 123/70 R
2010/0300385 A1 12/2010 Durrett et al.
(Continued)

FOREIGN PATENT DOCUMENTS

CN 1158940 A 9/1997
CN 102852633 A 1/2013
(Continued)

OTHER PUBLICATIONS

International Search Report and Written Opinion dated Oct. 5, 2017 in International Application No. PCT/EP2017/056108.
(Continued)

*Primary Examiner* — Kevin A Lathers
(74) *Attorney, Agent, or Firm* — Venable LLP; Jeffri A. Kaminski

(57) ABSTRACT

The invention relates to an internal combustion engine comprising a combustion cylinder housing a combustion piston, a compressor cylinder housing a compressor piston, an expander cylinder housing an expander piston, and a crankshaft connected to the combustion piston and the expander piston by a respective connecting rod. The internal combustion engine further comprises a connecting element rigidly connecting the compressor piston and the expander piston such that the compressor piston and the expander piston move in unison.

18 Claims, 6 Drawing Sheets

(56) References Cited

U.S. PATENT DOCUMENTS

| | | | | |
|---|---|---|---|---|
| 2011/0226224 | A1* | 9/2011 | Dean | F02B 33/22 123/70 R |
| 2014/0158102 | A1 | 6/2014 | Meldolesi et al. | |
| 2015/0090224 | A1 | 4/2015 | Clarke | |

FOREIGN PATENT DOCUMENTS

| | | | |
|---|---|---|---|
| CN | 104564335 | A | 4/2015 |
| CN | 105829677 | A | 8/2016 |
| DE | 102012013406 | A1 | 1/2014 |
| FR | 2708970 | A1 | 2/1995 |
| WO | 2015090340 | A1 | 6/2015 |
| WO | 2015144188 | A1 | 10/2015 |
| WO | 2016142592 | A1 | 9/2016 |

OTHER PUBLICATIONS

China Office Action dated Dec. 2, 2020 in corresponding China Patent Application No. 201780088215.5, 13 pages.

* cited by examiner

INTERNAL COMBUSTION ENGINE

TECHNICAL FIELD

The present invention relates to an internal combustion engine. The invention is applicable on vehicles, in particularly heavy vehicles, such as e.g. trucks. However, although the invention will mainly be described in relation to a truck, the internal combustion engine is of course also applicable for other type of vehicles, such as cars, industrial construction machines, wheel loaders, etc.

BACKGROUND

For many years, the demands on internal combustion engines have been steadily increasing and engines are continuously developed to meet the various demands from the market. Reduction of exhaust gases, increasing engine efficiency, i.e. reduced fuel consumption, and lower noise level from the engines are some of the criteria that becomes an important aspect when choosing vehicle engine. Furthermore, in the field of trucks, there are applicable law directives that have e.g. determined the maximum amount of exhaust gas pollution allowable. Still further, a reduction of the overall cost of the vehicle is important and since the engine constitutes a relatively large portion of the total costs, it is natural that also the costs of engine components are reduced.

In order to meet the described demands, various engine concepts have been developed throughout the years where conventional combustion cylinders have been combined with e.g. a pre-compression stage and/or an expansion stage.

In a four stroke engine, the cylinder performs four strokes in a cycle, i.e. intake, compression, power and exhaust. For example, in a four stroke internal combustion engine working by e.g. the conventional Otto cycle or the Diesel cycle, each cylinder in the engine performs four strokes per cycle. Thus, each power stroke results in two revolutions of the crank shaft. In contrast, a two-stroke engine completes a power cycle with two strokes of the cylinder during only one crankshaft revolution, as the end of the power stroke and the beginning of the compression stroke happen simultaneously, and the intake and exhaust functions occurring at the same time.

U.S. Pat. No. 967,828 disclose an internal combustion engine with an object of minimizing the number of cylinders and moving parts required to perform an engine cycle. The internal combustion engine in U.S. Pat. No. 967,828 comprises a high-pressure cylinder and a low-pressure cylinder, which are connected to each other by means of two conduits. The low-pressure cylinder is equipped to alternately perform the functions of a compressor and an expander. Hereby, the need of a separate compressor and a separate expander is reduced, and the internal combustion engine can be made relatively compact.

However, today's highly power efficient engines put new demands on compact design, lower friction and lower heat dissipation of the internal combustion engine. There is thus a need in the industry for further improvements.

SUMMARY

In view of the above-mentioned and other drawbacks of the prior art, the object of the present inventive concept is to provide an internal combustion engine which is compact while still providing for a relatively high power efficiency, and which at least alleviates above mentioned problems. The object is at least partly achieved by an internal combustion engine according to claim 1.

According to a first aspect of the invention there is provided an internal combustion engine comprising:

- at least one combustion cylinder housing a combustion piston, said combustion cylinder being configured to be energized by forces of combustion;
- a compressor cylinder housing a compressor piston, said compressor cylinder being configured to compress a volume of air and transfer the compressed air to the at least one combustion piston;
- an expander cylinder housing an expander piston, said expander cylinder being configured to receive exhaust gases from the at least one combustion piston;
- a crankshaft connected to said at least one combustion piston and said expander piston by a respective connecting rod, wherein the internal combustion engine further comprises a connecting element rigidly connecting said compressor piston and said expander piston such that the compressor piston and the expander piston move in unison.

As the expander piston and the compressor piston are rigidly connected by the connecting element, the internal combustion engine can be made more compact. More specifically, as the expander piston and the compressor piston are rigidly connected to each other, the total height of the expander piston and the compressor piston can be lower compared to a design in which the expander piston and the compressor piston are not rigidly connected to each other. Moreover, the connecting element provide a mechanically stiff connection between the expander piston and the compressor piston, thus increasing the mechanically stability of the internal combustion engine. In a conventional piston, the height of the piston, i.e. the piston skirt (typically being of the same size as the diameter of the piston), aims to prevent misalignment of the piston inside of the cylinder. By having a connecting element connecting the expander piston and the compressor piston, the expander piston contributes in aligning the compressor piston inside of the compressor cylinder, and the compressor piston contributes in aligning the expander piston inside of the expander cylinder. Hereby, the height (or skirt) of the respective piston can be reduced, resulting in e.g. lower friction losses.

Moreover, compared to a conventional two-stroke engine in which lubrication of the connecting rod coupling at the piston end (i.e. the small end of the connecting rod) is difficult to accomplish, the lubrication of the expander piston connecting rod in the internal combustion engine of the invention is relatively easy to carry out as compressor piston is rigidly connected to the expander piston, and thus move in unison with the latter. In more detail, in a conventional two-stroke engine, the journal bearing at the small end of the connecting rod is only moving back and forth during a crankshaft revolution. A non-rotating journal bearing is difficult to lubricate. Moreover, in a four-stroke engine the small end of the connecting rod is lubricated at the top dead centre (TDC) between the exhaust stroke and the intake stroke. Hereby, the relatively low gas pressure and acceleration of the piston enable "lifting" of the piston from the piston pin whereby lubricating oil can enter the journal bearing. Comparing again with the conventional two-stroke engine, the always relatively high gas pressure at TDC is too high for the piston acceleration to overcome, and thus it is difficult to get the lubrication oil into the journal bearing. The invention solves this problem (as for the four-stroke engine) since the gas pressure in the compressor exerts an upward force on the expander piston, and as this force is larger than the counter force from the gas in the expander cylinder during the second half of the expander power stroke. Hereby, lubricating oil can enter into the journal bearing at the small end of the expander connecting rod.

It should be understood that at least one combustion piston is arranged inside the at least one combustion cylinder, and is adapted for reciprocating motion therein. Correspondingly, the compressor piston and the expander piston are arranged inside the compressor cylinder and the expander cylinder, respectively, and are adapted for reciprocating motion therein. Moreover, a "downward" stroke of the compressor piston is referred to a stroke of the compressor piston in which the air in the compressor cylinder is compressed. Correspondingly, an "upward" stroke of the compressor piston is referred to a stroke of the compressor piston in the opposite direction. Moreover, as the expander piston is rigidly connected to the compressor piston by the connecting element and thereby move in unison with compressor piston, the downward and upward strokes of the compressor piston coincides with the respective strokes of the expander piston.

According to at least one embodiment, said compressor piston is connected to said crankshaft via said expander piston, such that a rotational motion of said crankshaft is transferred into a reciprocating motion of said compressor piston via the expander piston connecting rod.

Thus, according to at least one embodiment, the expander piston and the compressor piston are arranged with a common connecting rod. That is, the compressor piston is connected to the crankshaft via the expander piston connecting rod.

In other words, the crankshaft is driven by the at least one combustion piston via its connecting rod, i.e. a combustion piston connecting rod, and is driven by the expander piston via its connecting rod, i.e. an expander piston connecting rod.

By having a connecting element rigidly connecting the expander piston with the compressor piston, and an expander piston connecting rod transferring the reciprocating motion of both the expander and compressor pistons into a rotational motion of the crankshaft, the resulting lateral forces at the compressor piston are very small. More specifically, the lateral forces arise due to the connecting rod angle and are applied to the expander piston at the expander piston pin (the piston pin connecting the expander piston to the connecting rod). As there is no piston pin at the compressor piston, since the compressor piston is not connected to the crankshaft via its own connecting rod, the lateral forces are mainly distributed to the expander piston and are further transferred to an inner surface of the expander cylinder. Stated differently, resulting forces, such as lateral forces acting on the piston(s), originating from the transferring of reciprocating motion of the piston(s) into rotational motion of the crankshaft by means of the connecting rod (i.e. here the expander piston connecting rod) can be mainly distributed to the expander piston where the connecting rod from the crankshaft is coupled, and as there is no connecting rod directly connecting the compressor piston to the crankshaft. Thus, according to at least one embodiment, the compressor piston is a connecting rod-free compressor piston.

In other words, the expander piston connecting rod transfers the reciprocating motion of the compressor piston and the expander piston to a rotational motion of said crankshaft.

According to one embodiment, said crankshaft is driven by said at least one combustion piston by means of the combustion piston connecting rod, and is driven by said expander piston by means of said expander piston connecting rod, wherein said compressor piston is driven by said crankshaft by means of said expander piston.

That is, the crankshaft is driven, i.e. receives power from, the combustion cylinder and combustion piston due to forces of combustion, and from the expander cylinder and expander piston due to forces of expansion. Moreover, the crankshaft drives, i.e. deliver power to, the compressor piston and the compressor cylinder in order to compress the air. Thus, the crankshaft is rotatably driven by power pistons, i.e. at least said at least one combustion piston and said expander piston, by means of connecting rods, and the crankshaft drives power consuming pistons, i.e. at least the compressor piston, by means of the connecting rods already existing and used for the power pistons. In other words, and according to one embodiment, the internal combustion comprises connecting rods only directly connected to the power pistons, i.e. said at least one combustion piston and said expander piston.

According to one embodiment said expander piston has an expander piston height and an expander piston diameter, and wherein the expander piston height is smaller than ⅓ of the expander piston diameter, preferably smaller than ⅕ of the expander piston diameter, or more preferably smaller than 1/10 or 1/15 of the expander piston diameter.

By having a connecting element connecting the expander piston and the compressor piston, the height, or the skirt, of the expander piston can be reduced. In other words, the connecting element provides mechanical stability enabling the height, or skirt, of the expander piston to be reduced. According to one example embodiment, the height, or skirt, of the expander piston is sized and dimensioned relative the expander piston sealing arrangement.

According to one embodiment, said compressor piston has a compressor piston height and a compressor piston diameter, and wherein the compressor piston height is smaller than ⅓ of the compressor piston diameter, preferably smaller than ⅕ of the compressor piston diameter, or more preferably smaller than 1/10 or 1/15 of the compressor piston diameter.

By having a connecting element connecting the expander piston and the compressor piston, the height, or the skirt, of the compressor piston can be reduced. In other words, the connecting element provides mechanical stability enabling the height, or skirt, of the compressor piston to be reduced. According to one example embodiment, the height, or skirt, of the compressor piston is sized and dimensioned relative the compressor piston sealing arrangement.

It should be understood that the height of the respective piston is often referred to as the skirt of the piston, and that the diameter of the expander piston is typically the diameter of the expansion volume facing surface, and the diameter of the compressor piston is typically the diameter of the compression volume facing surface.

By reducing the height, or skirt, of the expander piston and/or the compressor piston, the respective piston can move inside of their respective cylinder with less friction. According to one example embodiment, the diameter of the compressor piston is smaller compared to the diameter of the expander piston. For example, the diameter of the compressor piston is between ½ to 1/99 of the diameter of the expander piston, such as e.g. about ⅔ of the diameter of the expander piston.

According to one embodiment, said compressor piston, said expander piston and a portion of said crankshaft are arranged along a geometrical axis, and wherein said portion of said crankshaft is arranged along said geometrical axis in between said compressor piston and said expander piston.

Hereby, a compact design of the internal combustion engine can be achieved. Said portion of the crankshaft can be described as being intermediary of said expander piston and said compressor piston. Said portion of the crankshaft may e.g. be a segment of the crankshaft along a longitudinal direction of the crankshaft.

According to one embodiment, a reciprocating motion of said expander piston inside of said expander cylinder occurs along an expander axis, and a reciprocating motion of said at least one combustion piston inside said combustion cylinder occurs along a combustion axis. According to one embodiment, said geometrical axis coincides with said expander axis and said compressor axis.

According to one embodiment, said compressor piston, said expander piston and said portion of said crankshaft are arranged in a geometrical plane extending at least along one of the expander axis and the compressor axis, and perpendicular to a longitudinal axis of the crankshaft, wherein said portion of said crankshaft is arranged in the geometrical plane in a direction perpendicular to the longitudinal axis of the crankshaft between said compressor piston and said expander piston.

According to one embodiment, at least a portion of said compressor piston, at least a portion of said expander piston and at least a portion of said connecting element together form a compressor-expander arrangement surrounding said portion of said crankshaft. According to one embodiment, said compressor-expander arrangement encloses, or encompasses, said portion of said crankshaft.

Thus, a compact design of the internal combustion engine can be achieved. Stated differently, at least a portion of the expander piston, at least a portion of the connecting element, and at least a portion of the compressor piston may form a geometrical frustum, or geometrical cylinder, which surrounds, or houses or encloses, said portion of said crankshaft. Stated differently, the expander piston may comprise at least an expander volume facing surface, and a crankshaft facing surface, and correspondingly the compressor piston may comprise at least a compressor volume facing surface, and a crankshaft facing surface, wherein said portion of said crankshaft is arranged in between the respective crankshaft facing surfaces.

According to one embodiment, said expander piston has a circular cross section extending in a first geometrical plane, and said compressor piston has a circular cross section extending in a second geometrical plane, said first and second geometrical planes being positioned in a parallel configuration on opposite sides of a longitudinal axis of the crankshaft.

It should be noted that the pistons may not be entirely circular in their respective cross section due to considerations of thermal expansion of the pistons. Thus, said expander piston cross section may be referred to as a round or elliptical cross section, extending perpendicular to the expander axis (i.e. the expander axis extends perpendicular into the cross section), and said compressor piston cross section may be referred to as a round, or elliptical cross section, extending perpendicular to the compressor axis (i.e. the compressor axis extends perpendicular into the cross section), and wherein said portion of said crankshaft is arranged between the cross section of the expander piston and the cross section of the compressor piston.

According to one embodiment, said expander cylinder and said compressor cylinder are co-axially arranged. Thus, alignment of the expander cylinder and the compressor cylinder inside the respective cylinder are facilitated. According to one embodiment, the crankshaft is located closer to the compressor cylinder compared to the expander cylinder. According to one embodiment, the combustion piston connecting rod is coupled to the crankshaft (i.e. the large end of the connecting rod) on the same crankshaft side as the expander connecting rod, opposite to said compressor piston. Hereby, the risk of colliding of internal components is reduced. Thus, a compact design of the internal combustion engine can be achieved. Moreover, the resulting lateral forces previously described can be kept at a minimum.

According to one embodiment, said expander cylinder and said compressor cylinder are offset compared to each other. That is, the expander axis and the compressor axis are parallel, but not coinciding.

According to one embodiment, a reciprocating motion of said expander piston inside of said expander cylinder occurs along an expander axis, and a reciprocating motion of said at least one combustion piston inside said combustion cylinder occurs along a combustion axis, and wherein said expander cylinder and said at least one combustion cylinder is arranged inside said internal combustion engine in such way that said expander axis is angled in relation to said combustion axis by between 40 degrees and 90 degrees, preferably between 50 degrees and 75 degrees, and more preferably between 55 degrees and 65 degrees, such as e.g. about 60 degrees.

Thus, the internal components, such as e.g. the various pistons and corresponding connecting rods with their reciprocating and/or rotational motions, can be adapted to be kept out of the way from each other as the move internally inside the internal combustion engine. Hereby, the internal combustion engine may be made compact. The at least one combustion cylinder may thus be described as protruding laterally from said crankshaft compared to said expander cylinder.

According to one embodiment, the expander piston connecting rod and the combustion piston connecting rod are coupled to the crankshaft by a respective crank pin. Thus, the expander piston and the at least one combustion piston may individually be phased relative each other in relation to the crankshaft. Hereby, an even distribution of torque pulses can be achieved. According to one embodiment, the expander piston connecting rod and the combustion piston connecting rod are coupled to the crankshaft by the same crank pin.

According to one embodiment, said expander piston is at least partly insulated. Hereby, the internal combustion engine may be made more efficient. For example, at least a portion of said expander piston is outwardly equipped with an insulating layer.

According to one embodiment, the internal combustion engine further comprises an expander piston sealing arrangement sealing said expander piston to an inner surface of said expander cylinder, and a compressor piston sealing arrangement sealing said compressor piston to an inner surface of said compressor cylinder, wherein said expander piston sealing arrangement is independent from said compressor piston sealing arrangement.

That is, the expander cylinder and the compressor cylinder may be individually sealed. That is, the expander piston sealing arrangement may be configured and arranged with no, or very little, adaptation to the compressor piston sealing arrangement. In other words, as the expander piston is physically separated from the compressor piston by the connecting element, the expander piston may be sealed independently of the sealing of the compressor piston.

According to one embodiment, the expander piston is physically separated from the compressor piston by the connecting element. That is, the expander piston and the compressor piston are not a common piston, but rather two separate pistons rigidly connected by the connecting element. Thus, the expander piston, the compressor piston and the connecting element may be referred to as a compressor-expander arrangement in which the two pistons are rigidly connected to each other by the connecting element. The expander piston, the compressor piston and the connecting element may according to one embodiment be made in one piece, and/or be comprised in one single unit.

According to one embodiment, said expander piston sealing arrangement comprises a liner, such as e.g. a honed liner, comprised in an inner surface of said expander cylinder, and at least one metal ring arranged circumferentially in an outer surface of said expander piston, and wherein said compressor piston sealing arrangement comprises a polished surface comprised in an inner surface of said compressor cylinder, and at least one non-metallic and/or polymeric ring arranged circumferentially in outer surface of said compressor piston.

Hereby, the expander piston and the compressor piston may be independently sealed with e.g. conventional respective sealing configurations.

According to one embodiment, said at least one combustion cylinder is a first combustion cylinder and said combustion piston is a first combustion piston, and said internal combustion engine further comprises a second combustion cylinder housing a second combustion piston, said second combustion cylinder being configured to be energized by forces of combustion.

Thus, the at least one combustion cylinder may be referred to as at least two combustion cylinders. The second combustion piston is according to one embodiment connected to said crankshaft via a connecting rod. That is, the first and the second combustion pistons are connected to the same crankshaft.

It should be understood that the at least one combustion cylinder, or the at least two combustion cylinders, is according to one embodiment at least partly arranged between said expander piston and said compressor piston. For example, the connecting rod(s) of the combustion cylinder(s) may be arranged between said expander piston and said compressor piston.

According to one embodiment, said first and second combustion cylinders operate in a four-stroke configuration, and each one of said compressor and expander cylinders operate in a two-stroke configuration.

According to one embodiment, said first and second combustion cylinders operate in common in a four-stroke configuration. According to one embodiment, said first and second combustion cylinders each operate in a two-stroke configuration. According to one embodiment, said first and second combustion cylinders each operate in a four-stroke configuration.

Thus, the overall stroke of the internal combustion engine may be referred to as an eight-stroke engine (the respective two-stroke configuration of the expander and the compressor cylinders, and the four-stroke configuration of the combustion cylinders). According to one embodiment, the internal combustion engine is referred to as a dual compression expansion engine, DCEE.

According to one embodiment, said compressor cylinder is a first compressor cylinder and said compressor piston is a first compressor piston, said expander cylinder is a first expander cylinder and said expander piston is a first expander piston, and said connecting element is a first connecting element, said internal combustion engine further comprises:

- a third combustion cylinder and a fourth combustion cylinder housing a respective third and fourth combustion piston, said combustion cylinders being configured to be energized by forces of combustion;
- a second compressor cylinder housing a second compressor piston, said second compressor cylinder being configured to compress a volume of air and transfer the compressed air to the third and fourth combustion pistons;
- a second expander piston cylinder housing a second expander piston, said second expander cylinder being configured to receive exhaust gases from the third and fourth combustion pistons;
- a second connecting element rigidly connecting said second compressor piston and said second expander piston such that the second compressor piston and the second expander piston move in unison, wherein said crankshaft is connected to said third and fourth combustion pistons and said second expander piston by a respective connecting rod.

Hereby, a power-efficient and yet compact internal combustion engine is provided. It should be understood that at least said first and second combustion cylinders, said first compressor cylinder, said first expander cylinder, and said first connecting element may be referred to as a first engine half of the internal combustion engine, and that at least said third and fourth combustion cylinders, said second compressor cylinder, said second expander cylinder, and said second connecting element may be referred to as a second engine half of the internal combustion engine. Said first and second engine halves of the internal combustion engine may be identical, or at least very similar, to each other in size and configuration. Thus, embodiments mentioned in relation to the first engine half is applicable to the second engine half, and to components in the second engine half, as well. The two engine halves may be off-set to each other in relation to the crankshaft with e.g. 180°.

According to one alternative embodiment, said third and fourth combustion pistons and said second expander piston are not connected to the same crankshaft as the first and second combustion pistons and said first expander piston, but to a secondary crankshaft.

According to one embodiment, the crankshaft may be configured as specifically weighted balance shaft to offset vibrations, as understood by those skilled in the art.

According to at least a second aspect of the present invention, the object is achieved by a vehicle according to claim 15. The vehicle comprising an internal combustion engine according to the first aspect of the invention.

Effects and features of this second aspect of the present invention are largely analogous to those described above in connection with the first aspect of the inventive concept. Embodiments mentioned in relation to the first aspect of the present invention are largely compatible with the second aspect of the invention.

According to a third aspect of the present invention, a crankshaft assembly is provided. The crankshaft assembly comprises

- a compressor piston adapted for reciprocating motion in a compressor cylinder for compression of a volume of air,
- an expander piston adapted for reciprocating motion in an expander cylinder for expansion of gases or air;

a crankshaft connected to said expander piston by a connecting rod, wherein the crankshaft assembly further comprises a connecting element rigidly connecting said compressor piston and said expander piston such that the compressor piston and the expander piston move in unison.

Thus, the crankshaft assembly may be used for the compression and expansion of air and gases and/or air, respectively, and provide a compact configuration of the internal components. The crankshaft assembly may e.g. be used for retrofitting an internal combustion engine according to the first and/or second aspect of the present invention. However, the crankshaft assembly may be used for other purposes as well, for example compression and expression of air, or combined with other energy driven sources such as e.g. an electrical motor or a battery.

The advantages of having a connecting element rigidly connecting said compressor piston and said expander piston mentioned in the first aspect of the invention is applicable to the third aspect of the invention as well. Moreover, embodiments related to the configuration of the compressor piston, the expander piston, the connecting element and the crankshaft mentioned in relation to the first aspect of the invention are applicable to the third aspect of the invention as well.

Thus, for example, and according to at least one embodiment, said compressor piston is connected to said crankshaft via said expander piston, such that a rotational motion of said crankshaft is transferred into a reciprocating motion of said compressor piston via the expander piston connecting rod. Thus, according to at least one embodiment, the expander piston and the compressor piston are arranged with a common connecting rod.

For example, and according to one embodiment, at least a portion of said compressor piston, at least a portion of said expander piston and at least a portion of said connecting element together forms a compressor-expander arrangement enclosing said portion of said crankshaft.

According to one embodiment, the crankshaft assembly comprises at least one combustion piston adapted for reciprocating motion in a combustion cylinder, said at least one combustion cylinder being configured to be energized by forces of combustion.

For example, and according to one embodiment, said expander piston is configured for reciprocating motion inside of the expander cylinder along an expander axis, and the at least one combustion piston is configured for reciprocating motion inside of the combustion cylinder along a combustion axis, wherein an angle between said expander axis and said combustion axis is between 40 degrees and 90 degrees, preferably between 50 degrees and 75 degrees, and more preferably between 55 degrees and 65 degrees, such as e.g. about 60 degrees.

According to one example embodiment, the crankshaft assembly further comprises a compressor cylinder housing said compressor piston, and an expander cylinder housing said expander piston. According to one example embodiment, the crankshaft assembly further comprises at least one combustion cylinder housing said at least one combustion piston.

Further advantages and advantageous features of the invention are disclosed in the following description and in the dependent claims.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

DETAILED DESCRIPTION OF EXAMPLE EMBODIMENTS OF THE INVENTION

Figure 1:
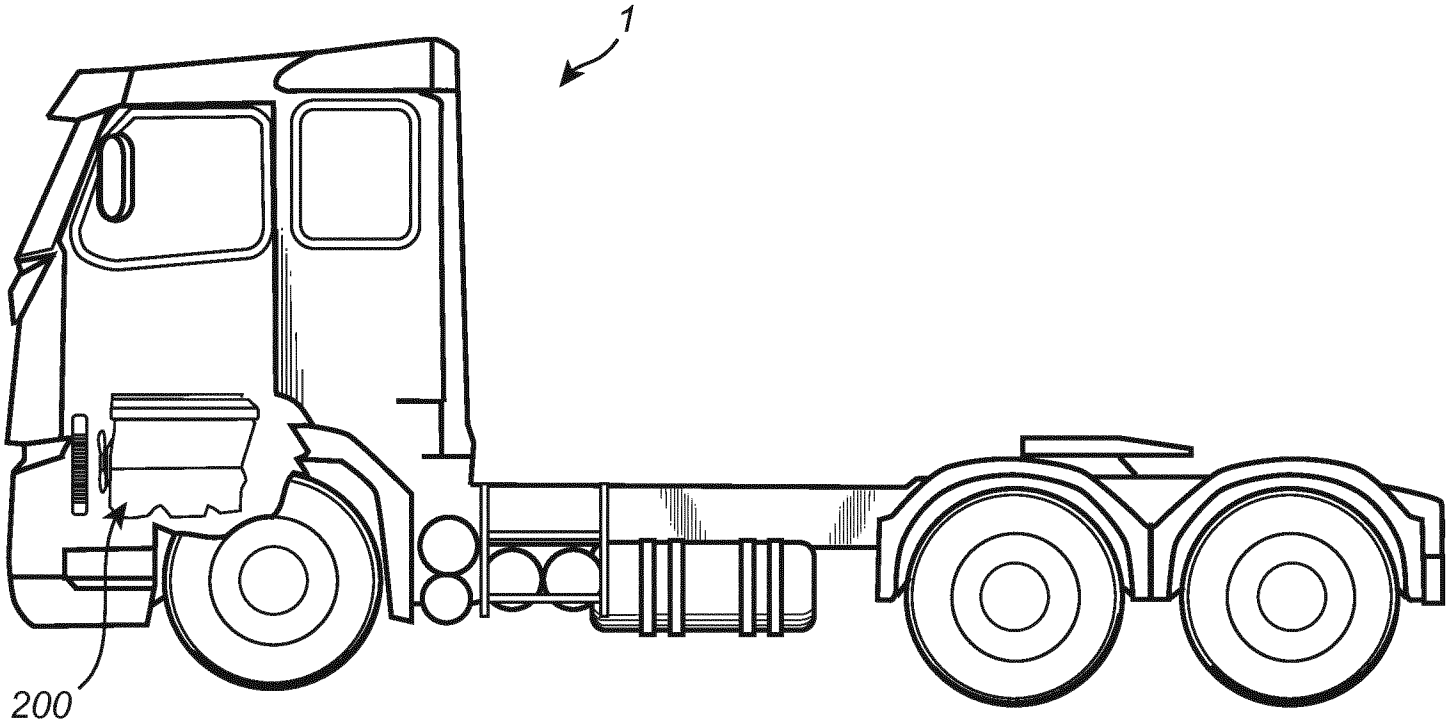
FIG. 1 is a side view of a vehicle comprising an internal combustion engine according to an example embodiment of the present invention.

The present invention will now be described more fully hereinafter with reference to the accompanying drawings, in which an exemplary embodiment of the invention is shown. The invention may, however, be embodied in many different forms and should not be construed as limited to the embodiment set forth herein; rather, the embodiment is provided for thoroughness and completeness. Like reference character refer to like elements throughout the description.

With particular reference to FIG. 1, there is provided a vehicle 1 with an internal combustion engine 200 according to the present invention. The vehicle 1 depicted in FIG. 1 is a truck for which the inventive internal combustion engine 200, which will be described in detail below, is particularly suitable for.

Figure 2A:
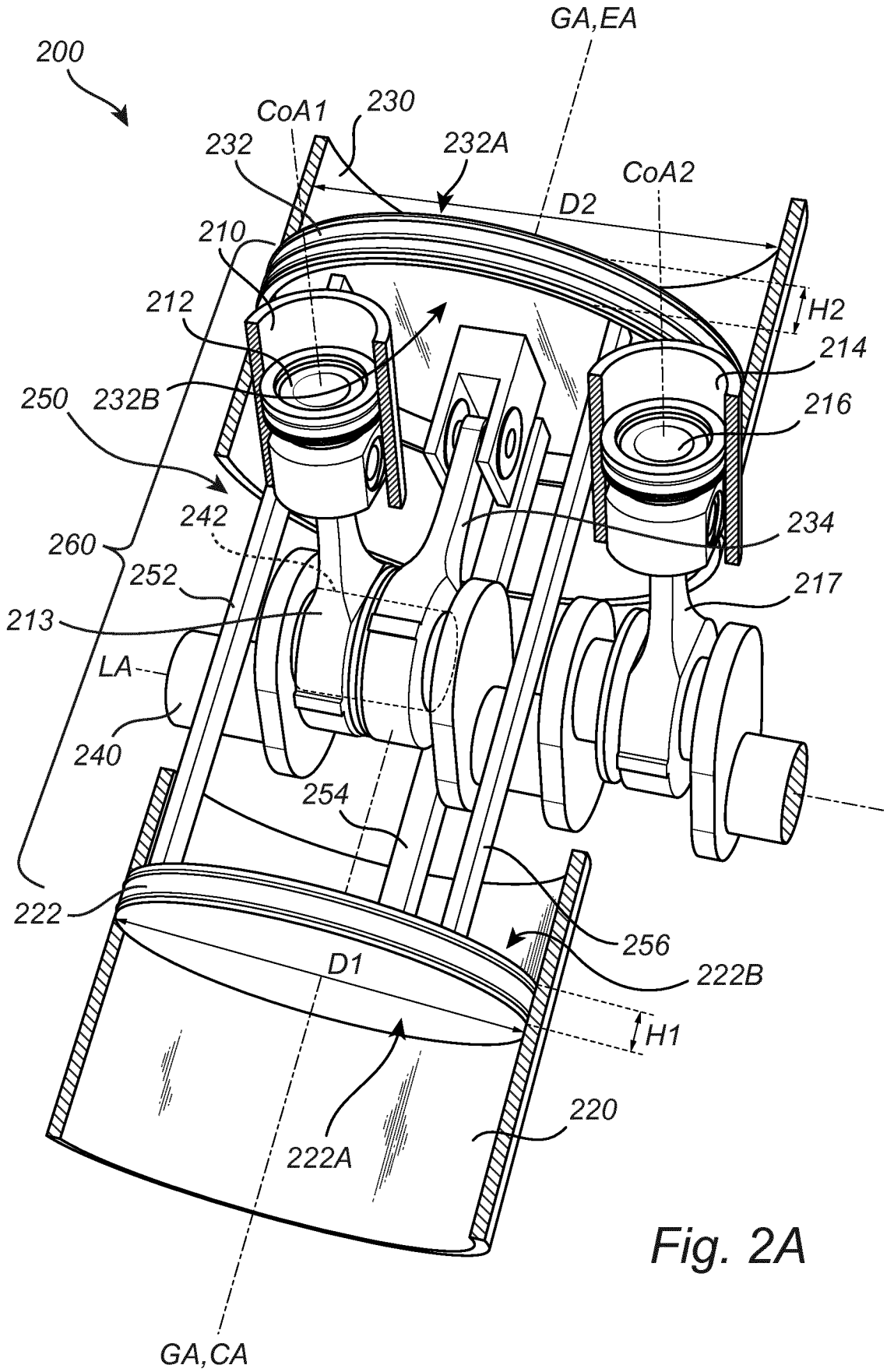
FIGS. 2A and 2B are perspective views of the internal combustion engine according to an example embodiment of the present invention.
Figure 2B:
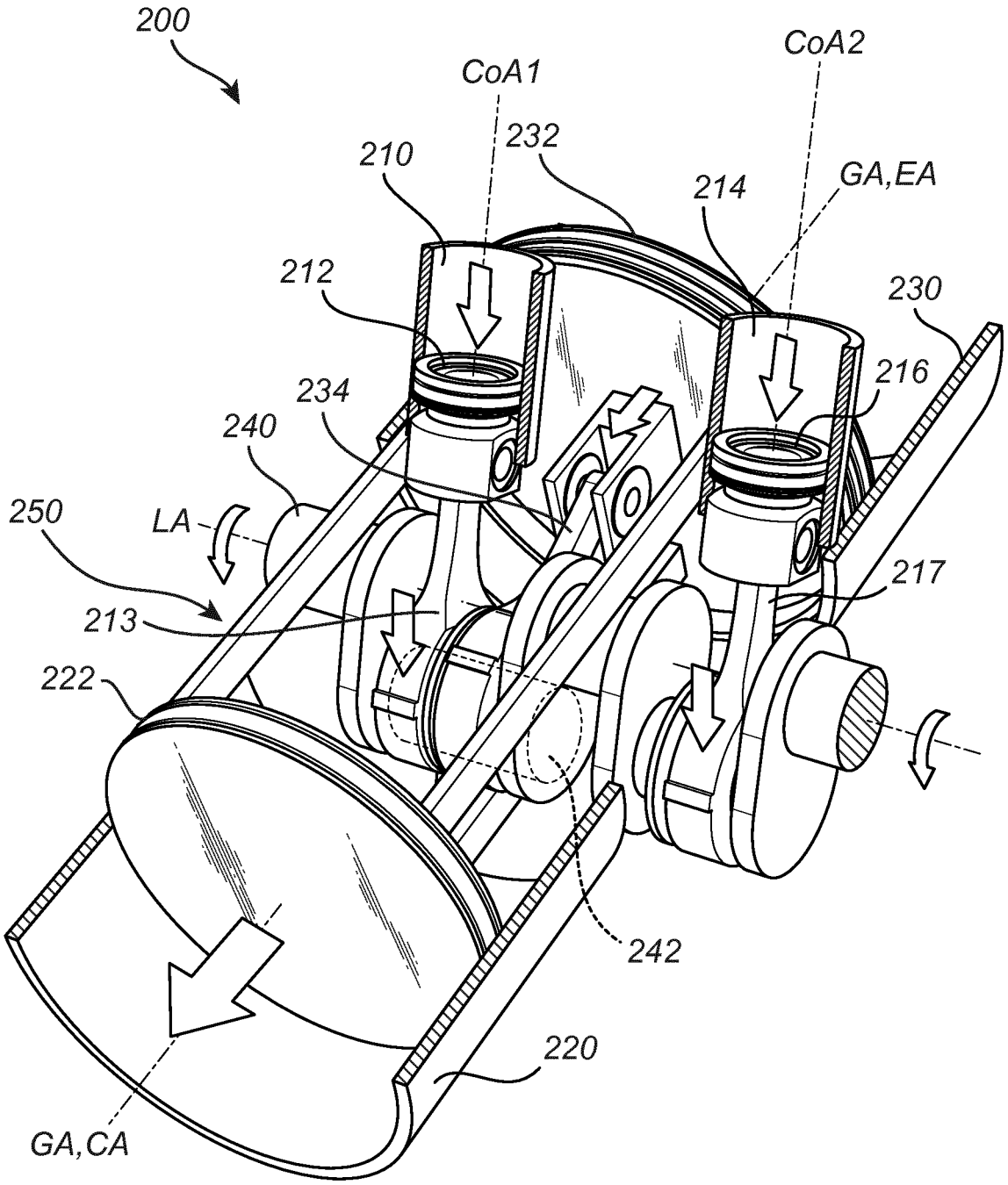

Turning to FIGS. 2A and 2B, which illustrate an internal combustion engine 200 according to an example embodiment of the present invention. A full illustration of the cylinders housing the respective pistons have been omitted from FIGS. 2A and 2B for simplicity of understanding the invention and the piston configuration.

The internal combustion engine 200 comprises a first combustion cylinder 210 housing a first combustion piston 212, and a second combustion cylinder 214 housing a second combustion piston 216. The internal combustion engine 200 further comprises a compressor cylinder 220 housing a compressor piston 222, and an expander cylinder 230 housing an expander piston 232. It should be understood that the first and second combustion pistons 212, 216 are individually arranged inside the first and second combustion cylinders 210, 212, respectively, and are adapted for reciprocating motion therein. Correspondingly, the compressor piston 222 and the expander piston 232 are arranged inside the compressor cylinder 220 and the expander cylinder 230, respectively, and are adapted for reciprocating motion therein.

As shown in FIG. 2A, the internal combustion engine 200 comprises a crank shaft 240, and an expander piston connecting rod 234 connecting the expander piston 232 to the crankshaft 240. Correspondingly, a first combustion piston connecting rod 213 connects the first combustion piston 212 to the crankshaft 240, and a second combustion piston connecting rod 217 connects the second combustion piston 214 to the crankshaft 240. Thus, the above mentioned reciprocating motions of the pistons can be transferred into a rotational motion of the crankshaft 240.

In FIG. 2A, the expander piston 232 is connected to the compressor piston 222 by a connecting element 250. More specifically, in FIG. 2A, the expander piston 232 is connected to the compressor piston 222 by three connecting arms 252, 254, 256 arranged in a respective periphery portion of the expander and compressor cylinders 232, 222. Each one of the connecting arms 252, 254, 256 extends from the expander piston 232 to the compressor piston. Even though three connecting arms 252, 254, 256 are shown in FIG. 2A, it should be understood that other number of connecting arms, or only one connecting arm, may be used within the concept of the invention. Thus, at least one embodiment, the connecting element 250 comprises at least one connecting arm 252, 254, 256, such as e.g. three connecting arms 252, 254, 256. Moreover, the connecting element 250 may be arranged with no connecting arms, but instead as e.g. a connecting envelope extending from the expander piston 232 to the compressor piston 222, such that the expander piston 232 and the compressor piston 222 move in unison. Hence, in the following description the connecting element 250 will be referred to in singulars.

The connecting element 250 is to be understood as rigidly connecting the expander piston 232 to the compressor piston 222, such that the expander piston 232 and the compressor piston 222 move in unison. The expander piston 232 may comprise at least an expander volume facing surface 232A, and a crankshaft facing surface 2328, and correspondingly the compressor piston 222 may comprise at least a compressor volume facing surface 222A, and a crankshaft facing surface 222B. Thus, the connecting element 250 rigidly connects the expander piston 232 with the compressor piston 222 such that the respective crankshaft facing surfaces 232B, 222B faces each other. Hence, as the compressor piston 222 moves in a downstroke (i.e. in order to compress the air in the compressor cylinder 220), the expander piston 232 moves in a stroke following the motion of the compressor piston 222. Correspondingly, as the expander piston 232 moves in an upstroke, the compressor piston 222 moves in a stroke following the motion of the expander piston 232.

As shown in FIG. 2A, the compressor cylinder 220 and the expander cylinder 230 are positioned on opposite sides of, and in close proximity to, the crankshaft 240. Stated differently, a portion 242 of said crankshaft 240 is arranged in between the expander piston 232 and the compressor piston 222, such that the portion 242 is arranged between the respective crankshaft facing surfaces 232B, 222B. In other words, the compressor piston 222, the expander piston 232 and the portion 242 of the crankshaft 240 are arranged along a geometrical axis GA, and the portion 242 of the crankshaft 240 is along the geometrical axis GA in between the compressor piston 222 and the expander piston 232. The internal position of the components in the internal combustion engine 200 may be described in a different manner:
at least a portion of the compressor piston 222, such as its crankshaft facing surface 222B, at least a portion of the expander piston 232, such as its crankshaft facing surface 232B, and at least a portion of the connecting element 250 together forms a compressor-expander arrangement 260 enclosing the portion 242 of the crankshaft 240.

In at least a third way of describing the internal position of the components in the internal combustion engine 200, the expander piston 232 has a circular, or round, cross section extending in a first geometrical plane, and the compressor piston 222 has a circular, or round, cross section extending in a second geometrical plane, the first and second geometrical planes being positioned in a parallel configuration on opposite sides of a longitudinal axis LA of the crankshaft 240.

As seen best in FIG. 2B, the expander piston 232 is configured for a reciprocating motion inside of the expander cylinder 230 along an expander axis EA. Correspondingly, the compressor piston 222 is configured for a reciprocating motion inside of the compressor cylinder 220 along a compressor axis CA. Correspondingly, the first combustion pistons 212 is configured for a reciprocating motion inside of the first combustion cylinder 210 along a combustion axis CoA1, and the second combustion pistons 216 is configured for a reciprocating motion inside of the second combustion cylinder 214 along a combustion axis CoA2. As seen in FIG. 2B, the expander cylinder 230 and the compressor cylinder 220 are co-axially arranged, i.e. the expander axis EA and the compressor axis CA are aligned.

Turning back to FIG. 2A, it is shown that first combustion cylinder 210, and the second combustion cylinder 214 may be described as protruding laterally from said crankshaft 240 compared to the expander cylinder 230. Thus, the expander cylinder 230, and the first and second combustion cylinders 210, 214 are arranged inside the internal combustion engine 200 in such way that the expander axis EA is angled in relation to each one of the combustion axis CoA1, CoA2 by between 40 degrees and 90 degrees, preferably between 50 degrees and 75 degrees, and more preferably between 55 degrees and 65 degrees, such as e.g. about 60 degrees.

Moreover, the expander piston 230 has an expander piston height H2 and an expander piston diameter D2, wherein the expander piston height H2 is smaller than ⅓ of the expander piston diameter D2, preferably smaller than ⅕ of the expander piston diameter D2, or more preferably smaller than 1/10 or 1/15 of the expander piston diameter D2. In FIG. 2A, shown as an example, the expander piston height H2 is about 1/10 of the expander piston diameter D2.

Correspondingly, the compressor piston 220 has a compressor piston height H1 and a compressor piston diameter D1, wherein the compressor piston height H1 is smaller than ⅓ of the compressor piston diameter D1, preferably smaller than ⅕ of the compressor piston diameter D1, or more preferably smaller than 1/10 or 1/15 of the compressor piston diameter D1. In FIG. 2A, shown as an example, the compressor piston height H1 is about 1/12 of the compressor piston diameter D1. As also shown in FIG. 2A, the compressor piston diameter D1 is smaller compared to the expander piston diameter D2.

The function of the internal combustion engine 200 will now be further elucidated with reference FIG. 2B. The compressor cylinder 220 is configured to draw a volume of ambient air, compress the air, and transfer the compressed air to the first and second combustion cylinders 210, 214. The first and second combustion cylinders 210, 214 are configured to be energized by forces of combustion, e.g. by ignition of the fuel by means of a spark plug (e.g. as for a petrol or gasoline driven engine) or heat originating from compression (e.g. as for a diesel driven engine). The expander cylinder 230 is configured to receive exhaust gases from the first and second combustion pistons 210, 214. Transportation of air, fuel and gases are carried out by means of inlet valves, transfer ports, and outlet valves known by the skilled person in the art, and which fluidly interconnects the compressor cylinder 220, the first and second combustion cylinders 210, 214 and the expander cylinder 230.

Note that in the internal combustion engine 200 in FIG. 2A, the compressor piston 222 is not directly connected to the crankshaft 240, via its own connecting rod, but is instead connected to the crankshaft 240 via the connecting element 250, the expander piston 232 and the expander piston connecting rod 234. Hereby, the rotational motion of the crankshaft 240 (indicated by rotational arrows) is transferred into a reciprocating motion of the compressor piston 220 via the expander piston connecting rod 234. Thus, the crankshaft 240 is driven by the first and second combustion pistons 212, 216 by means of the respective combustion piston connecting rods 213, 217 and is driven by the expander piston 232 by means of the expander piston connecting rod 234, but the crankshaft 240 drives the compressor piston 222 by means of the expander piston 230 and the expander piston connecting rod 234.

Figure 3:
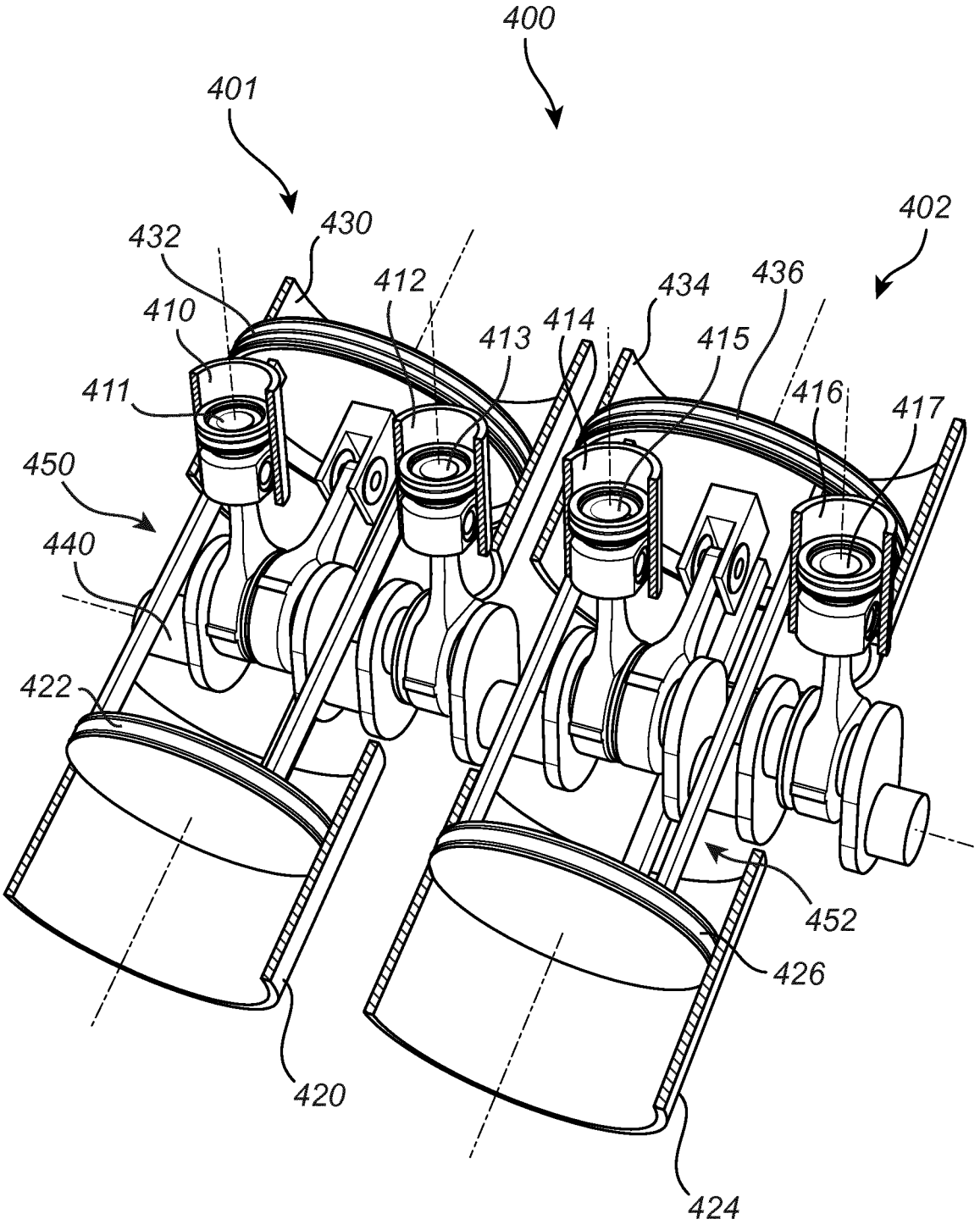
FIG. 3 is a perspective view of the internal combustion engine according to yet another example embodiment of the present invention.

FIG. 3 shows an internal combustion engine 400 comprising a first engine half 401 and a second engine half 402. The first and second engine halves 401, 402 are each one identical and comprise the same components as the internal combustion engine shown in FIGS. 2A and 2B. As the components and their respective functions have been described with reference to FIGS. 2A and 2B, they are not repeated in detail here again. However, the main components of the internal combustion engine 400 are briefly described.

The internal combustion engine 400 in FIG. 3 comprises a first combustion cylinder 410 housing a first combustion piston 411, a second combustion cylinder 412 housing a second combustion piston 413, a third combustion cylinder 414 housing a third combustion piston 415, and a fourth combustion cylinder 416 housing a fourth combustion piston 417. The internal combustion engine 400 further comprises a first compressor cylinder 420 housing a first compressor piston 422, a second compressor cylinder 424 housing a second compressor piston 426, a first expander cylinder 430 housing a first expander piston 432, and a second expander cylinder 434 housing a second expander piston 436. It should be understood that the pistons are individually arranged inside the respective cylinders, and are adapted for reciprocating motion therein. Moreover, the internal combustion engine 400 of FIG. 4 comprises a first connecting element 450 rigidly connecting the first compressor piston 422 and the first expander piston 432 such that the first compressor piston 422 and the first expander piston 432 move in unison, and comprises a second connecting element 452 rigidly connecting the second compressor piston 426 and the second expander piston 436 such that the second compressor piston 426 and the second expander piston 436 move in unison. Moreover, a crankshaft 440 is connected to the first, second, third and fourth combustion pistons 411, 413, 415, 417 by a respective connecting rod, and is connected to the first and second expander pistons 432, 436 by a respective connecting rod.

Figure 4:
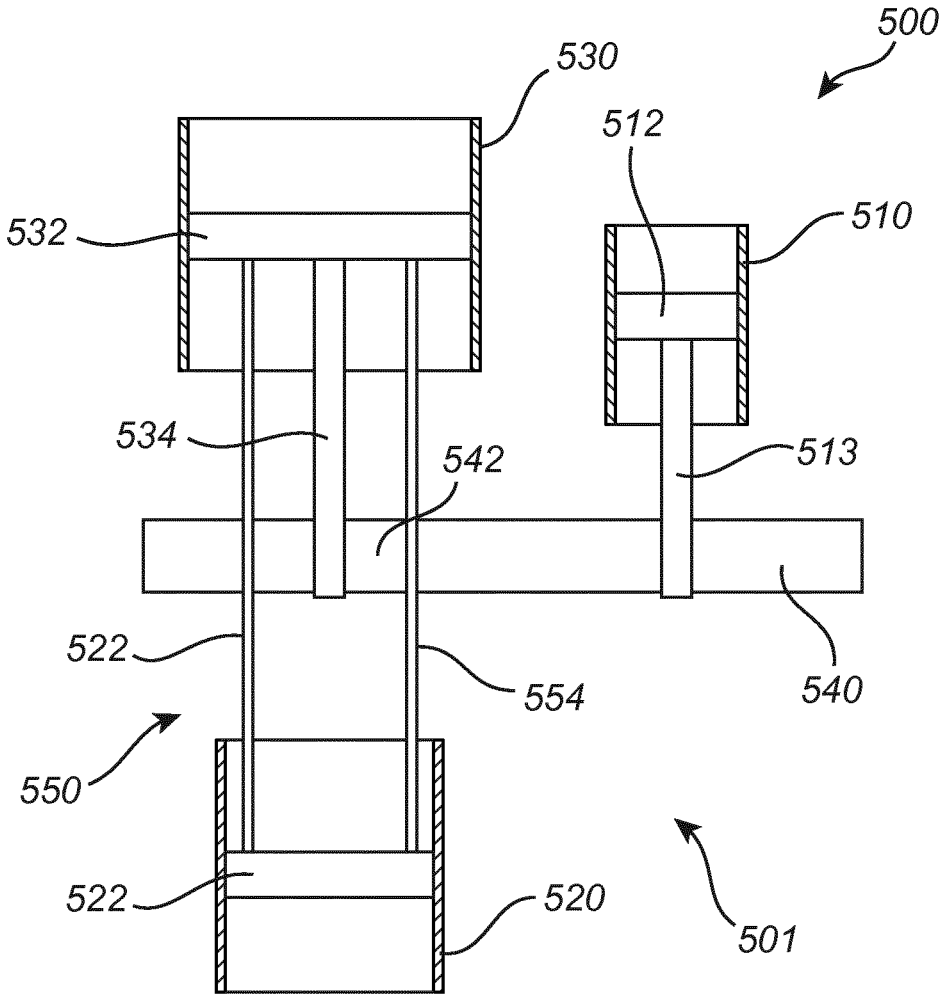
FIG. 4 schematically illustrates an internal combustion engine according to an example embodiment of the present invention.

FIG. 4 schematically illustrates an internal combustion engine 500 according to an example embodiment of the present invention. The internal combustion engine 500 comprises a combustion cylinder 510 housing a combustion piston 512, a compressor cylinder 520 housing a compressor piston 522, and an expander cylinder 530 housing an expander piston 532. It should be understood that the combustion piston 512 is arranged inside the combustion cylinder 510 and is adapted for a reciprocating motion therein. Correspondingly, the compressor piston 522 and the expander piston 532 are arranged inside the compressor cylinder 520 and the expander cylinder 530, respectively, and are adapted for reciprocating motion therein.

As shown in FIG. 4, the internal combustion engine 500 comprises a crank shaft 540, and an expander piston connecting rod 534 connecting the expander piston 532 to the crankshaft 540. Correspondingly, a combustion piston connecting rod 513 connects the combustion piston 512 to the crankshaft 540. Thus, the above mentioned reciprocating motions of the pistons can be transferred into a rotational motion of the crankshaft 540.

In FIG. 4, the expander piston 532 is connected to the compressor piston 522 by a connecting element 550. More specifically, in FIG. 4, the expander piston 532 is connected to the compressor piston 522 by two connecting arms 552, 554. Each one of the connecting arms 552, 554 extends from the expander piston 532 to the compressor piston 522. The connecting element 550 is to be understood as rigidly connecting the expander piston 532 to the compressor piston 522, such that the expander piston 532 and the compressor piston 522 move in unison. Hence, as the compressor piston 522 moves in a downstroke (i.e. in order to compress the air in the compressor cylinder 520), the expander piston 532 moves in a stroke following the motion of the compressor piston 522. Correspondingly, as the expander piston 532 moves in an upstroke, the compressor piston 522 moves in a stroke following the motion of the expander piston 532.

As shown in FIG. 4, the compressor cylinder 520 and the expander cylinder 530 are positioned on opposite sides of, and in close proximity to, the crankshaft 540. Stated differently, a portion 542 of said crankshaft 540 is arranged in between the expander piston 532 and the compressor piston 522.

The internal combustion engine 500 in FIG. 4 may e.g. be used in a serial hybrid, e.g. as a range extender. In such embodiments, the crankshaft 540 may not be directly coupled to the driving means of the vehicle.

In FIG. 4, the compressor piston 522, the expander piston 532, the crankshaft 540, the expander piston connecting rod 534, and the connecting element 550 may be referred to as a crankshaft assembly 501 in accordance with the third aspect of the present invention. Optionality, the combustion piston 512 and the combustion piston connecting rod 513 and/or any one of the cylinders 510, 520, 530 are comprised in the crankshaft assembly 501.

Figure 5:
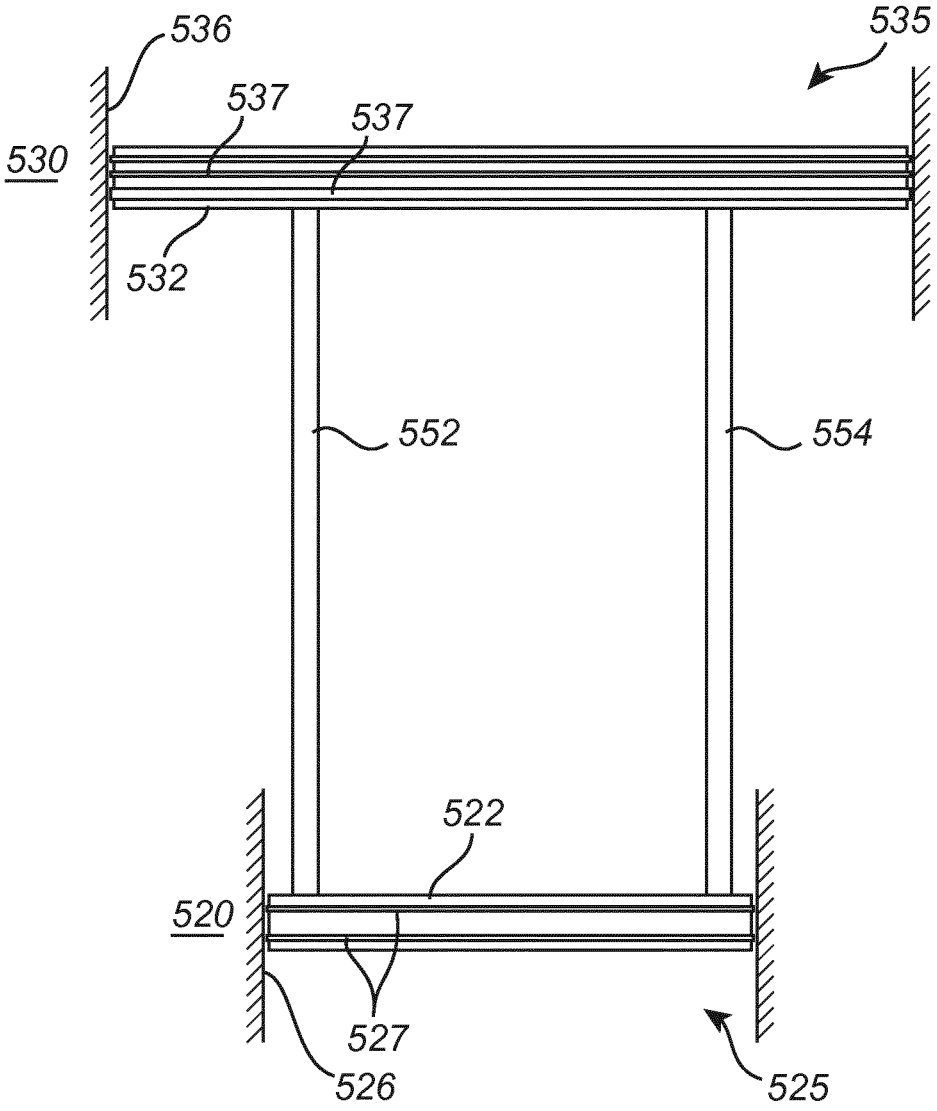
FIG. 5 schematically illustrates parts of the internal combustion engine of FIG. 4.

FIG. 5 show parts of the internal combustion engine 500, or parts of the crankshaft assembly 501, of FIG. 4. In FIG. 5 an expander piston sealing arrangement 535 sealing the expander piston 532 to an inner surface of the expander cylinder 530, and a compressor piston sealing arrangement 525 sealing the compressor piston 522 to an inner surface of the compressor cylinder 520 is shown (the cylinders 530, 520 have largely been omitted from FIG. 5, and the distances between the inner surfaces of the cylinders 520, 530 and the respective pistons 532, 522 have been exaggerated, for simplicity of understanding the sealing arrangements 535, 525). As is clear from FIG. 5, the expander piston sealing arrangement 535 is independent, and functionally separated, from the compressor piston sealing arrangement 525. More specifically, in FIG. 5, the expander piston sealing arrangement 535 comprises a honed liner 536 comprised in an inner surface of said expander cylinder 530, and at least one metal ring 537 arranged circumferentially in an outer surface of the expander piston 532 (as shown in FIG. 5, more metal rings, such as e.g. three metal rings may be arranged circumferentially in the outer surface of the expander piston 532). Moreover, the compressor piston sealing arrangement 525 comprises a polished surface 526 comprised in an inner surface of said compressor cylinder 520, and at least one non-metallic, or polymeric, ring 527 arranged circumferentially in an outer surface of the compressor piston 525 (as shown in FIG. 5, more non-metallic, or polymeric, rings, such as e.g. two rings may be arranged circumferentially in the outer surface of the compressor piston 522).

It is to be understood that the present invention is not limited to the embodiments described above and illustrated in the drawings; rather, the skilled person will recognize that many changes and modifications may be made within the scope of the appended claims.

The invention claimed is:

1. An internal combustion engine comprising: at least one combustion cylinder housing a combustion piston, said combustion cylinder being configured to be energized by forces of combustion; a compressor cylinder housing a compressor piston, said compressor cylinder being configured to compress a volume of air and transfer the compressed air to the at least one combustion piston; an expander cylinder housing an expander piston, said expander cylinder being configured to receive exhaust gases from the at least one combustion piston; a crankshaft connected to said at least one combustion piston and said expander piston by a respective connecting rod, characterized in that the internal combustion engine further comprises a connecting element rigidly connecting said compressor piston and said expander piston such that the compressor piston and the expander piston move in unison.

2. An internal combustion engine according to claim 1, wherein said compressor piston is connected to said crankshaft via said expander piston, such that a rotational motion of said crankshaft is transferred into a reciprocating motion of said compressor piston via the expander piston connecting rod.

3. An internal combustion engine according to claim 1, wherein said crankshaft is driven by said at least one combustion piston by means of the combustion piston connecting rod, and is driven by said expander piston by means of said expander piston connecting rod, wherein said compressor piston is driven by said crankshaft by means of said expander piston.

4. An internal combustion engine according to claim 1, wherein said expander piston has an expander piston height and an expander piston diameter, and wherein the expander piston height is smaller than ⅓ of the expander piston diameter.

5. An internal combustion engine according to claim 1, wherein said compressor piston has a compressor piston height and a compressor piston diameter, and wherein the compressor piston height is smaller than ⅓ of the compressor piston diameter.

6. An internal combustion engine according to claim 1, wherein at least a portion of said compressor piston, at least a portion of said expander piston and at least a portion of said connecting element together forms a compressor-expander arrangement surrounding a portion of said crankshaft.

7. An internal combustion engine according to claim 1, wherein said expander piston has a circular cross section extending in a first geometrical plane, and said compressor piston has a circular cross section extending in a second geometrical plane, said first and second geometrical planes being positioned in a parallel configuration on opposite sides of a longitudinal axis of the crankshaft.

8. An internal combustion engine according to claim 1, wherein said expander cylinder and said compressor cylinder are co-axially arranged.

9. An internal combustion engine according to claim 1, wherein a reciprocating motion of said expander piston inside of said expander cylinder occurs along an expander axis, and a reciprocating motion of said at least one combustion piston inside said combustion cylinder occurs along a combustion axis, and wherein said expander cylinder and said at least one combustion cylinder is arranged inside said internal combustion engine in such way that said expander axis is angled in relation to said combustion axis by between 40 degrees and 90 degrees.

10. An internal combustion engine according to claim 1, further comprising an expander piston sealing arrangement sealing said expander piston to an inner surface of said expander cylinder, and a compressor piston sealing arrangement sealing said compressor piston to an inner surface of said compressor cylinder, wherein said expander piston sealing arrangement is independent from said compressor piston sealing arrangement.

11. An internal combustion engine according to claim 10, wherein said expander piston sealing arrangement comprises a liner, comprised in an inner surface of said expander cylinder, and at least one metal ring arranged circumferentially in an outer surface of said expander piston, and wherein said compressor piston sealing arrangement comprises a polished surface comprised in an inner surface of said compressor cylinder, and at least one non-metallic and/or polymeric ring arranged circumferentially in outer surface of said compressor piston.

12. An internal combustion engine according to claim 1, wherein said at least one combustion cylinder is a first combustion cylinder and said combustion piston is a first combustion piston, and said internal combustion engine further comprises a second combustion cylinder housing a second combustion piston, said second combustion cylinder being configured to be energized by forces of combustion.

13. An internal combustion engine according to claim 12, wherein said first and second combustion cylinders operate in a four-stroke configuration, and each one of said compressor and expander cylinders operate in a two-stroke configuration.

14. An internal combustion engine according to claim 12, wherein said compressor cylinder is a first compressor cylinder and said compressor piston is a first compressor piston, said expander cylinder is a first expander cylinder and said expander piston is a first expander piston, and said connecting element is a first connecting element, said internal combustion engine further comprises: a third combustion cylinder and a fourth combustion cylinder housing a respective third and fourth combustion piston, said combustion cylinders being configured to be energized by forces of combustion; a second compressor cylinder housing a second compressor piston, said second compressor cylinder being configured to compress a volume of air and transfer the compressed air to the third and fourth combustion pistons; a second expander piston cylinder housing a second expander piston, said second expander cylinder being configured to receive exhaust gases from the third and fourth combustion pistons; a second connecting element rigidly connecting said second compressor piston and said second expander piston such that the second compressor piston and the second expander piston move in unison, wherein said crankshaft is connected to said third and fourth combustion pistons and said second expander piston by a respective connecting rod.

15. A vehicle comprising an internal combustion engine according to claim 1.

16. An internal combustion engine according to claim 1, wherein said expander piston has an expander piston height and an expander piston diameter, and wherein the expander piston height is smaller than smaller than 1/15 of the expander piston diameter.

17. An internal combustion engine according to claim 1, wherein said compressor piston has a compressor piston height and a compressor piston diameter, and wherein the compressor piston height is smaller than 1/10 of the compressor piston diameter.

18. An internal combustion engine according to claim 1, wherein a reciprocating motion of said expander piston inside of said expander cylinder occurs along an expander axis, and a reciprocating motion of said at least one combustion piston inside said combustion cylinder occurs along a combustion axis, and wherein said expander cylinder and said at least one combustion cylinder is arranged inside said internal combustion engine in such way that said expander axis is angled in relation to said combustion axis by between 55 degrees and 65 degrees.

* * * * *